United States Patent [19]

Linsenmann

[11] 4,186,696

[45] Feb. 5, 1980

[54] PUSH RODS AND THE LIKE

[75] Inventor: Don R. Linsenmann, Westfield, N.J.

[73] Assignee: Exxon Research & Engineering Co., Florham Park, N.J.

[21] Appl. No.: 873,938

[22] Filed: Jan. 31, 1978

[51] Int. Cl.[2] ..... F01L 1/14

[52] U.S. Cl. ..... 123/90.61; 64/1 S; 138/130

[58] Field of Search ..... 123/90.61; 64/1 S, 1 R; 138/130, 174, 118 R; 403/341, 284

[56] References Cited

U.S. PATENT DOCUMENTS

| | | | |
|---|---|---|---|
| 2,584,696 | 2/1952 | Graham | 403/284 |
| 2,747,616 | 5/1956 | De Ganahl | 138/130 |
| 2,969,812 | 1/1961 | De Ganahl | 138/130 |
| 3,500,869 | 3/1970 | Skoggard | 138/130 |
| 3,669,158 | 6/1972 | Phillips | 138/118 R |
| 3,691,000 | 9/1972 | Kalnin | 138/174 |
| 3,725,981 | 4/1973 | Pinckney | 403/341 |
| 4,013,101 | 3/1977 | Logan | 138/130 |
| 4,089,190 | 5/1978 | Worgan | 64/1 R |

FOREIGN PATENT DOCUMENTS

| | | | |
|---|---|---|---|
| 2152289 | 4/1973 | France | 64/1 S |
| 1343983 | 1/1974 | United Kingdom | 123/90.61 |

OTHER PUBLICATIONS

"Low-Cost High-Performance Carbon Fibers," William E. Chambers, Mechanical Engineering, Dec. 1975, pp. 37-41.

"Advanced Fiber-Resin Composites," Berg and Filippi, Machine Design, Apr. 1, 1971.

*Primary Examiner*—Charles J. Myhre
*Assistant Examiner*—Jeffrey L. Yates
*Attorney, Agent, or Firm*—Joseph J. Dvorak

[57] ABSTRACT

An improved tubular composite for transmitting substantial thrust forces has a tubular core of continuous reinforcing fibers in a resin matrix unidirectionally and longitudinally oriented. Integral with the core is a sheath of resin impregnated continuous fibers oriented at about ±40° to about ±60° with respect to the longitudinal axis of the core.

7 Claims, 6 Drawing Figures

PUSH RODS AND THE LIKE

BACKGROUND OF THE INVENTION

1. Field of the Invention

The present invention relates generally to light weight composite tubular elements specifically adapted to withstand compressive forces. In particular, the present invention relates to push rods employed in internal combustion engines.

2. Prior Art

Presently, transmitting thrust between a cam shaft and a valve rocker in an internal combustion engine to operate the valve is accomplished by means of a metallic push rod. Metal rods have long since been the material of choice for such devices because of the compressive forces to which the rods are subjected and the inherent elastic stiffness required to preclude buckling failure. Recent emphasis on increasing fuel economy of such internal combustion engines has led to the proposal of replacing numerous parts of such engines by lighter weight materials that are equal in strength and stiffness to the metal components. In U.K. Pat. No. 1,343,983, for example, a push rod having a plastic shank reinforced with carbon fiber and metal thrust transmitting members secured at both ends of the shank is disclosed. All the fibers of the patented push rod are longitudinally oriented. Among the disadvantages of having solely longitudinally oriented reinforcing fibers in such a push rod is the fact that the compressive forces tend to broom the ends of the reinforcing fibers, thereby resulting in shortened life of the rod and that such rods do not provide sufficient shear resistance.

SUMMARY OF THE INVENTION

Generally speaking, the present invention provides an improved tubular composite for transmitting substantial thrust forces in which the compressive loads are borne primarily by continuous unidirectional longitudinally oriented reinforcing fiber filaments in a resin matrix. The longitudinally oriented reinforcing fibers additionally are encased in an external sheath of fibers oriented at a predetermined angle of orientation. Thus, in one embodiment of the present invention there is provided a tubular composite structure for transmitting forces which comprises a central tubular core formed of a fiber-reinforced resin in which the fibers are oriented at substantially 0° with respect to the longitudinal axis of the tubular core and which central core is encased in a sheath of fiber-reinforced resin which has been thermally bonded to the core so as to be integral therewith. The fibers in the exterior sheath are cross-plied with respect to each other at angles of between about 85° to 95° and preferably at 90° and so disposed with respect to the longitudinal axis of the tubular core as to be oriented at an angle of about ±40° to about ±60° and preferably at about ±45°. The push rod additionally has metal thrust transmitting members secured adhesively at both ends of the tubular core.

These and other embodiments of the present invention will become readily apparent upon a reading of the detailed description which follows in conjunction with the drawings.

DETAILED DESCRIPTION OF THE INVENTION

Figure 1:
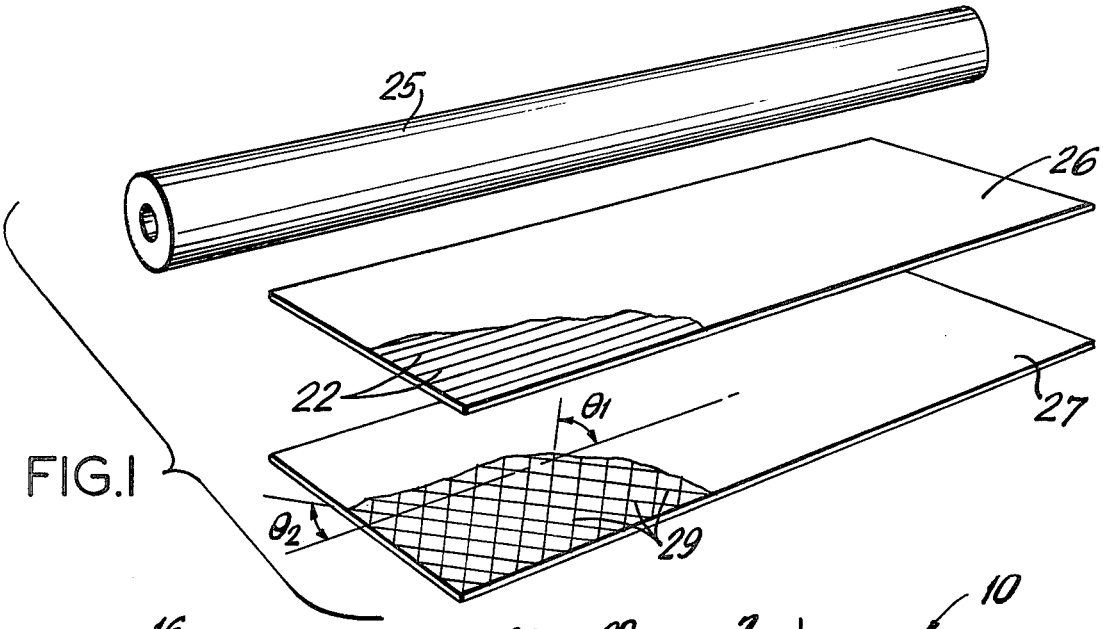
FIG. 1 is an isometric drawing, partially in perspective and partially cut away, showing a mandrel, a sheet of resin impregnated graphite fiber reinforcing material and a sheet of resin impregnated aromatic polyamide fiber reinforcing material used in forming the tubular element of the present invention.

Referring now to the drawings, it should be noted that like reference characters designate corresponding parts throughout the several drawings and views.

Figure 2:
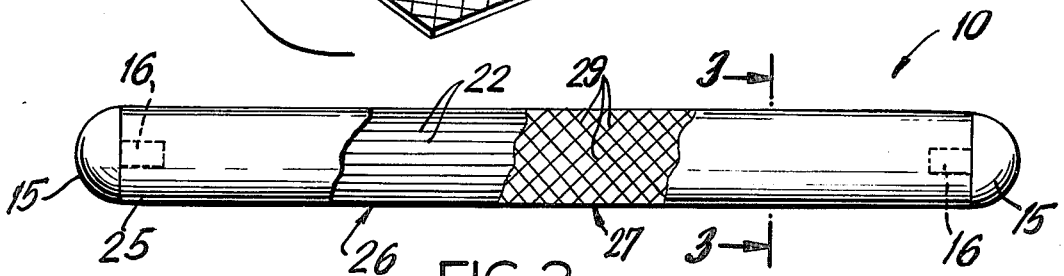
FIG. 2 is a side elevation, partially cut away, of a push rod of the present invention.

The push rod of the present invention has a shank shown generally as 10 in FIG. 2. At each end thereof are metal thrust members 15. As can be seen in FIG. 2, the metal thrust members 15 are generally ball shaped.

In fabricating the tubular element, a generally quadrangular, and preferably rectangular, sheet such as lamina 26 is cut from a sheet of resin impregnated unidirectional continuous reinforcing fibers. These reinforcing fibers are preferably carbon or graphite fibers; and, for convenience, these fibers will be hereinafter referred to as graphite fibers.

Figure 3:
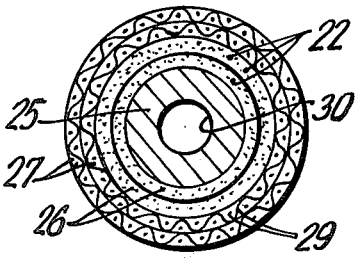
FIG. 3 is a cross-sectional view taken along lines 3—3 in FIG. 2.

The length of lamina 26 will be determined by the desired length of the push rod. The width of the rectangular resin impregnated fiber sheet material 26 preferably is sufficient so that it will take at least two wraps around a mandrel, such as mandrel 25, to provide a central core section of requisite wall thickness such as 26 shown in FIG. 3.

The resin material impregnating the graphite fibers 22 of rectangular sheet or lamina 26 is a thermosetting resin. Suitable thermosetting resins include epoxy and polyester resins.

The epoxy resins are polyepoxides which are well known condensation products of compounds containing oxirane rings with compounds containing hydroxyl groups or active hydrogen atoms such as amines, acids and aldehydes. The most common epoxy resin compounds are those of epichlorohydrin and bis-phenol and its homologs. The polyester resin is a polycondensation product of polybasic acids with polyhydric alcohols. Typical polyesters include polyterephthalates such as polyethylene terephthalate.

As is generally known in the art, these thermoset resins include modifying agents such as hardeners and the like. Forming such compounds is not part of the present invention. Indeed, the preferred modified epoxy resin impregnated graphite fibers are commercially available materials. The choice of a very specific material will depend largely upon the temperature conditions and other environmental factors to which the push rod is going to be exposed. Thus, for example, in the case of a push rod for an internal combustion engine which will be subjected to hot oil at temperatures in the range of about 150° C. to 165° C., the resin will be selected from commercial resins known to meet these particular requirements. For example, modified epoxy preimpregnated graphite fibers sold under the tradename HMS and 3501 by Hercules, Inc., Wilmington, Delaware are eminently suitable.

In general, the resin impregnated quadrangular sheet 26 will have a thickness of about 0.007 to 0.01 inches and contain from about 50 volume % to about 60 volume % graphite fibers in the thermoset resin matrix. Preferably the quadrangular sheet 26 used in the present invention has 55 volume % to 60 volume % of continuous unidirectional graphite fibers in an epoxy resin matrix. Indeed, it is especially preferred that the graphite fibers have a Youngs modulus of elasticity in the range of $30\times10^6$ to $50\times10^6$ psi and a tensile strength in the range of about 300,000 to about 400,000 psi.

Returning again to the drawings, and as can be seen in the cut-out of FIG. 2, the unidirectional graphite fibers 22 are oriented at 0° with respect to the longitudinal axis of the push rod body 10. Thus, in fabricating the push rod, the layer 26 of the requisite quadrangular shape is cut so that the continuous unidirectional graphite fibers 22 are substantially parallel to the lengthwise edge of the quadrangular sheet as shown in FIG. 1. After cutting the laminae 26 with the fibers 22 disposed in the proper manner, the sheet is merely rolled around the circumference of a mandrel such as mandrel 25 shown in FIG. 1.

Next, a second encasing layer 27 of resin-impregnated continuous fibers are cut from stock material in the same desired quadrangular pattern as layer 26. In this second layer 27, as can be seen from FIGS. 1 and 2, the fibers are cross-plied with respect to each other at about ±90°, although these fibers can be at angles of about 85° to about 95° with respect to each other. It also should be noted that the quadrangular sheet 27 is cut so that the fibers 29 therein will be oriented with respect to the lengthwise edge of the quadrangular sheet material so that substantially half the fibers are being oriented at one angle $\theta_1$ and substantially the remaining half of the fibers are oriented at an angle $\theta_2$ with respect to the length of the quadrangular sheet material. In all instances, the magnitudes of $\theta_1$ and $\theta_2$ are substantially the same; they are merely opposite in sign. Thus, the fibers 29 are hereinafter described as being oriented at between about ±40° to about ±60° and preferably at about ±45° with respect to the longitudinal axis of the tubular rod or lengthwise edge of the quadrangular sheet material.

In contrast to the fibers employed in the first sheet material 26, the fibers 29 employed in the external sheathing material 27 are selected from fiber materials having a tensile strength greater than about 250,000 psi and modulus greater than about 9,000,000 psi (ASTM Test Method 2256-66). Among commercially available fibers with the requisite properties are glass fibers and the aromatic polyamide fibers known as aramid fibers. Indeed, a particularly preferred fiber is an aramid fiber sold under the trade name Kevlar by DuPont, Wilmington, Delaware. The resin impregnating such fibers will be the same resin as that employed in sheet 26. Such pre-impregnated material is commercially available and sold under the trade name of Kevlar/3501 by Hercules Inc., Wilmington, Delaware.

Figure 4:
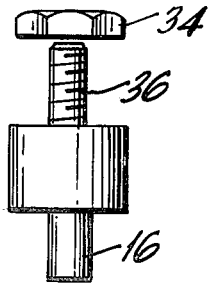
FIGS. 4 through 6 show additional metal thrust members that can be used in forming push rods of the present invention.

The width of layer 27 is sufficient so that it will form two wraps, as shown for example in FIG. 4, around layer 26 to provide the requisite wall thickness for the central core 10. After wrapping both sheet 26 and 27 around mandrel 25, the materials can be held in place by means of cellophane tape, for example. Alternatively, the assembly of core and exterior resin and impregnated fiber-reinforcing material can be held in place by a wrapping of polypropylene heat shrinkable film (not shown) which serves in effect as a mold and which can subsequently be removed as hereinafter described.

After wrapping the metal core with the requisite number of layers of material, the assembly is placed in an oven and heated to a temperature sufficient to cause the bonding of the separate layers in the various convolutions to each other. The temperature at which the assembly is heated depends upon a number of factors including the resin which is used to impregnate the graphite fibers. These temperatures are well known. Typically, for the modified epoxy resin impregnated graphite fiber employed in forming push rods, the temperature will be in the range of from about 175° C. to about 180° C. and preferably 177° C.

If an external polypropylene wrapping film is used to hold the various layers around the metal core, this can be removed simply by manually peeling it away from the surface of the shaft. Surface imperfections, if there are any, on the shank can be removed by sanding or grinding or the like. If so desired, the shank 10 can also be painted. After curing, of course, the mandrel 25 can be removed.

Additionally, it should be noted that while the invention is described herein with reference to a mandrel which is substantially circular in cross section, it should be readily appreciated that other shaped mandrels such as hexagonal and octagonal mandrels, to mention a few, may be employed. Additionally and optionally, the mandrel may be solid or a very thin metal tube, for example stainless steel having a thickness of about 10 mils, an O.D. of about 0.125 and an I.D. of about 0.105 in which event the mandrel may be left inside the resin central core.

Figure 5:
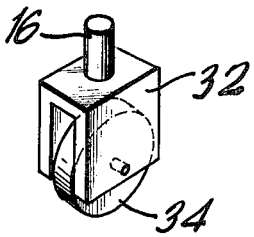
Figure 6:
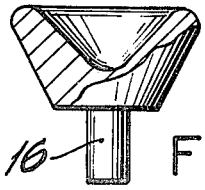

Turning back again to the drawings, it should be noted that the thrust members 15 of FIG. 2 as well as the thrust members of FIGS. 4, 5 and 6 all have a stud portion 16 which is adapted to be received in a snug relationship with the central opening 30 of the tubular body 10. Also, as can be seen in FIG. 2, the metal thrust members 16 shown therein have substantially ball shapes. The exact nature and shape of the metal thrust member, however, will vary depending upon the use to which the push rod is to be employed. In some instances, for example, a ball shaped metal thrust member will be employed at one end of the tubular body 10 whereas a cup shaped thrust transmitting member such as that shown in FIG. 6 will be employed at the other end of tubular body 10. In other types of engines, the metal thrust member will have, for example, a roller 34 journaled in a housing 32 as shown in FIG. 5. Such roller cam following mechanisms are well known. Similarly, in yet another embodiment, the end of the tubular body 10 may have a threaded metal thrust member for being bolted to a valve lifter, for example, via nut 34. The threads on this mechanism are shown generally as 36.

The metal of the metal thrust member is not critical and typically will be an iron alloy, especially steel.

To further illustrate the invention, reference is now made to a typical push rod for an 8-cylinder internal combustion engine used on a full-size automobile. In such application, the tubular body 10 will be in the range of 7½ to 8 inches long and will have an I.D. in the range of 0.120 to 0.130 inches and an O.D. in the range of 0.300 to 0.320. The central core will comprise unidirectional continuous graphite fibers oriented at 0° with respect to the longitudinal axis of the tubular body and there will be about 55 to 60 volume % of fibers in the resin matrix. Integral with and thermally bonded thereto is an exterior sheath consisting of fiber-reinforced aramid unidirectional fibers. The fibers in the sheath layer will be arranged at an angle of about ±40° to ±60° and preferably at ±45° with respect to the longitudinal axis of the shaft. Additionally, the sheath layer will generally have an I.D. of 0.290 to 0.300 and an O.D. of about 0.300 to 0.320. Embedded in the distal ends thereof are two substantially ball-shaped thrust members 15. Preferably the thrust members are bonded to the cylindrical core and tubular body 10 by means of a structural adhesive selected from adhesives which will withstand operation in hot oil at temperatures in the range of 150° C. to about 165° C. Among the suitable structural adhesives is EA934, sold by the Hysol Division of Dexter Corp., Industry, California.

Although the invention has been described with particular reference to push rods for conventional internal combustion engines, it should be appreciated that such push rods will have many other applications and, therefore, broad latitude, modification and substitution are intended in the foregoing disclosure. Accordingly, it is appropriate that the appended claims be construed broadly and in a manner consistent with the spirit and scope of the invention herein.

What is claimed is:

1. A push rod comprising:

a tubular body portion having a central core and an exterior sheath, said core being a fiber reinforced tubular resin member, said fibers being continuous unidirectional reinforcing fibers selected from carbon and graphite, said fibers being oriented at substantially 0° with respect to the longitudinal axis of said body portion, and said exterior sheath being a sheath of resin impregnated continuous unidirectional fibers integral with and disposed on said core, said fibers being oriented at between about ±40° and ±60° with respect to the longitudinal axis of said body portion, said fibers in said exterior sheath being selected from fibers having a tensile strength of greater than about 250,000 psi and a modulus greater than about 9,000,000 psi.

2. The rod of claim 1 wherein the resin is a thermoset resin.

3. The rod of claim 2 wherein said fibers are selected from glass fibers and aramid fibers.

4. The rod of claim 2 wherein said fibers are aramid fibers.

5. The rod of claim 4 including a thin metal tube interior said core.

6. The rod of claim 4 including metal thrust members.

7. The rod of claim 6 wherein the metal thrust members have substantially ball shapes and are adhesively bonded to the rod.

* * * * *